US011317213B2

(12) United States Patent
Kajiwara

(10) Patent No.: US 11,317,213 B2
(45) Date of Patent: Apr. 26, 2022

(54) DIAPHRAGM FOR ELECTROACOUSTIC TRANSDUCER

(71) Applicant: FOSTER ELECTRIC COMPANY, LIMITED, Tokyo (JP)

(72) Inventor: Hisami Kajiwara, Tokyo (JP)

(73) Assignee: FOSTER ELECTRIC COMPANY, LIMITED, Tokyo (JP)

( * ) Notice: Subject to any disclaimer, the term of this patent is extended or adjusted under 35 U.S.C. 154(b) by 0 days.

(21) Appl. No.: 17/284,713

(22) PCT Filed: Oct. 3, 2019

(86) PCT No.: PCT/JP2019/039100
§ 371 (c)(1),
(2) Date: Apr. 12, 2021

(87) PCT Pub. No.: WO2020/080123
PCT Pub. Date: Apr. 23, 2020

(65) Prior Publication Data

US 2021/0385580 A1 Dec. 9, 2021

(30) Foreign Application Priority Data

Oct. 17, 2018 (JP) ..... JP2018-195578

(51) Int. Cl.
*H04R 7/12* (2006.01)
*H04R 31/00* (2006.01)

(52) U.S. Cl.
CPC ..... *H04R 7/12* (2013.01); *H04R 31/003* (2013.01); *H04R 2307/021* (2013.01); *H04R 2307/023* (2013.01); *H04R 2307/029* (2013.01); *H04R 2499/13* (2013.01)

(58) Field of Classification Search
CPC .. H04R 7/12; H04R 31/003; H04R 2307/023; H04R 2307/029; H04R 2499/13
See application file for complete search history.

(56) References Cited

U.S. PATENT DOCUMENTS

| | | | | |
|---|---|---|---|---|
| 2016/0134972 | A1* | 5/2016 | Shibuya | H04R 9/04 381/405 |
| 2018/0270595 | A1 | 9/2018 | Hiraoka | |
| 2019/0297423 | A1* | 9/2019 | Shibuya | H04R 9/06 |

FOREIGN PATENT DOCUMENTS

| | | | | |
|---|---|---|---|---|
| CN | 105393558 | A | 3/2016 | |
| JP | H05-300586 | A | 11/1993 | |
| JP | 2018-152740 | A | 9/2018 | |
| WO | WO 2014/068834 | A1 | 5/2014 | |
| WO | WO-2014068834 | A1 * | 5/2014 | H04R 31/003 |
| WO | WO 2015/011903 | A1 | 1/2015 | |
| WO | WO 2018/008347 | A1 | 1/2018 | |

OTHER PUBLICATIONS

Dec. 17, 2019, International Search Report issued for related PCT application No. PCT/JP2019/039100.
Dec. 17, 2019, International Search Opinion issued for related PCT application No. PCT/JP2019/039100.

* cited by examiner

*Primary Examiner* — Sunita Joshi
(74) *Attorney, Agent, or Firm* — Patatus Law Group, PLLC

(57) ABSTRACT

In a diaphragm 1, at a front surface side surface layer of a base material 10 made of pulps 20 which are mainly composed of cellulose, a mixed layer 11 in which the pulps 20, mica 22, and cellulose nanofibers 21 are mixed is formed.

20 Claims, 4 Drawing Sheets

DIAPHRAGM FOR ELECTROACOUSTIC TRANSDUCER

CROSS REFERENCE TO PRIOR APPLICATION

This application is a National Stage Patent Application of PCT International Patent Application No. PCT/JP2019/039100 (filed on Oct. 3, 2019) under 35 U.S.C. § 371, which claims priority to Japanese Patent Application No. 2018-195578 (filed on Oct. 17, 2018), which are all hereby incorporated by reference in their entirety.

TECHNICAL FIELD

The present disclosure relates to a diaphragm for an electroacoustic transducer used in a speaker, a microphone, and the like.

BACKGROUND ART

A diaphragm for an electroacoustic transducer is generally required to have a low density, a high Young's modulus, an appropriate internal loss, etc., and a material having optimum physical properties is appropriately selected according to the application of a speaker or a microphone. Various materials may be used as a material of the diaphragm, and natural fibers (cellulose) are still widely used in view of performance and cost, but a desired rigidity may not be obtained in some cases.

Therefore, as a diaphragm for a speaker, a diaphragm has been proposed which has a three-layer structure including a base material layer formed of a papermaking material made of a plurality of fibers, an intermediate layer containing a plurality of cellulose fibers, and a coating layer containing an inorganic powder composed of a plurality of inorganic fine particles (Patent Literature 1).

In Patent Literature 1, the intermediate layer containing the cellulose fibers having a higher density than natural fibers is formed, and the coating layer is formed on a surface of the intermediate layer, thereby making a thickness of the coating layer uniform. In this way, by reducing a variation in the thickness of the coating layer, rigidity and a sound velocity of the diaphragm are improved. Further, by containing inorganic fine particles such as mica in the coating layer, the rigidity and sound pressure are further improved, and moisture resistance and moisture-proof property are also improved.

PRIOR ART DOCUMENT

Patent Literature

Patent Literature 1: WO 2018/008347

SUMMARY OF INVENTION

Problem to be Solved by the Invention

Since the inorganic fine particles such as mica have low affinity with fibers, as in the diaphragm of Patent Literature 1, separation of the inorganic fine particles from the diaphragm may be suppressed by using a coating material such as a thermoplastic resin in the coating layer, but when a coating material such as a resin or an adhesive is used, there is a problem that the mass of the diaphragm is increased and the sound pressure is reduced. In order to make the thickness of the coating material uniform, it is necessary to add a step such as forming the intermediate layer as in Patent Literature 1, which may complicate a production step.

On the other hand, in order to add the inorganic fine particles to a piece of paper without using the coating material, since a binding force between the fibers and the inorganic particles is small, the inorganic particles may fall off from the diaphragm. Further, papermaking (mixed papermaking) is also performed by mixing the inorganic particles with a base material without using the coating material, but in such a case, the amount of relatively expensive inorganic particles used increases so that cost increases.

An embodiment according to the present invention has been proposed in view of the above, and an object thereof is to provide a diaphragm for an electroacoustic transducer capable of improving physical properties and acoustic characteristics as a diaphragm, while suppressing an increase in cost and complication of a production step.

Means for Solving the Problem

In order to achieve the above object, in a diaphragm for an electroacoustic transducer according to an embodiment of the present invention, at a surface layer of a base material made of a fiber material which is mainly composed of cellulose, a mixed layer in which the fiber material, mica and a cellulose nanofiber are mixed is formed.

In the above diaphragm for an electroacoustic transducer, a particle size of the mica may be 10 μm or more and 500 μm or less.

Further, in the above diaphragm for an electroacoustic transducer, the mica may be coated with titanium oxide.

Further, in the above diaphragm for an electroacoustic transducer, a fiber length of the cellulose nanofiber may be 50 μm or less.

Further, in the above diaphragm for an electroacoustic transducer, the mixed layer may be formed by spraying a suspension containing the mica and the cellulose nanofiber onto another surface of the base material while suctioning and dehydrating the base material from one surface side thereof.

Further, the above diaphragm for an electroacoustic transducer may be for an in-vehicle speaker.

Effects of Invention

As described above, according to the embodiment according to the present invention as described above, physical properties and acoustic performance as a diaphragm can be improved, while suppressing an increase in cost and complication of a production step.

EMBODIMENTS FOR CARRYING OUT THE INVENTION

Hereinafter, a diaphragm for an electroacoustic transducer according to an embodiment of the present invention will be described.

Figure 1A:
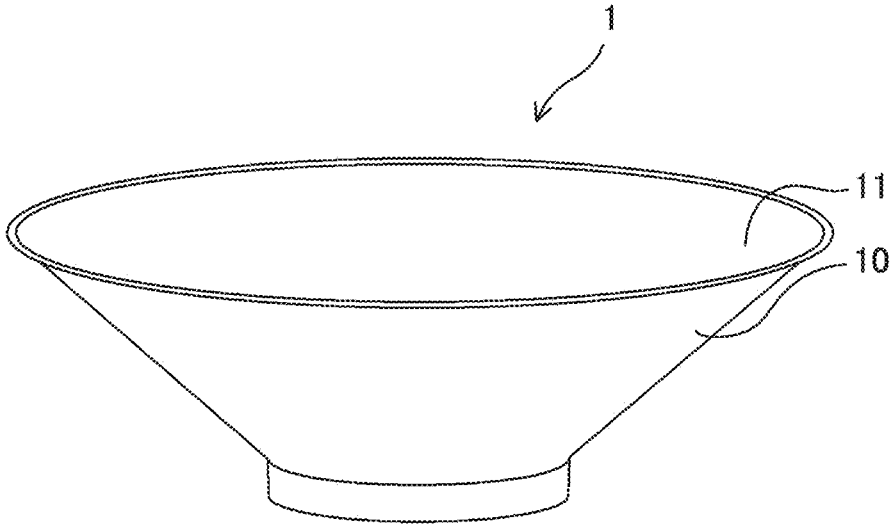
FIG. 1A is a perspective view illustrating a diaphragm for an electroacoustic transducer according to an embodiment of the present invention.
Figure 1B:
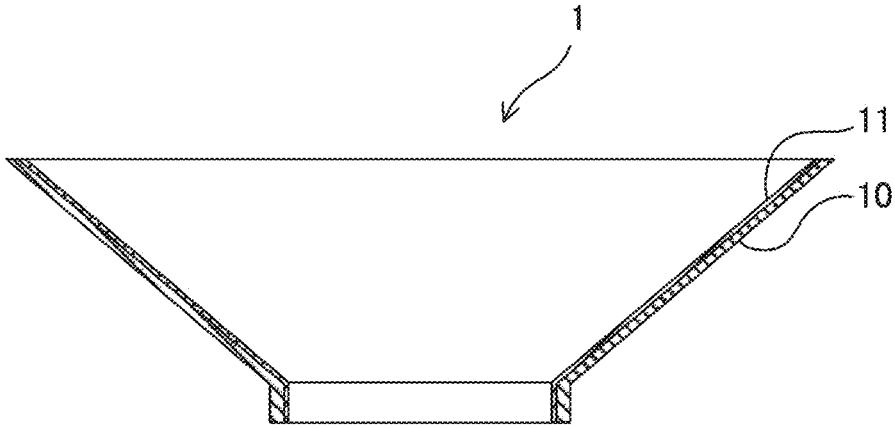
FIG. 1B is a cross-sectional view illustrating the diaphragm for an electroacoustic transducer according to the embodiment of the present invention.
Figure 2:
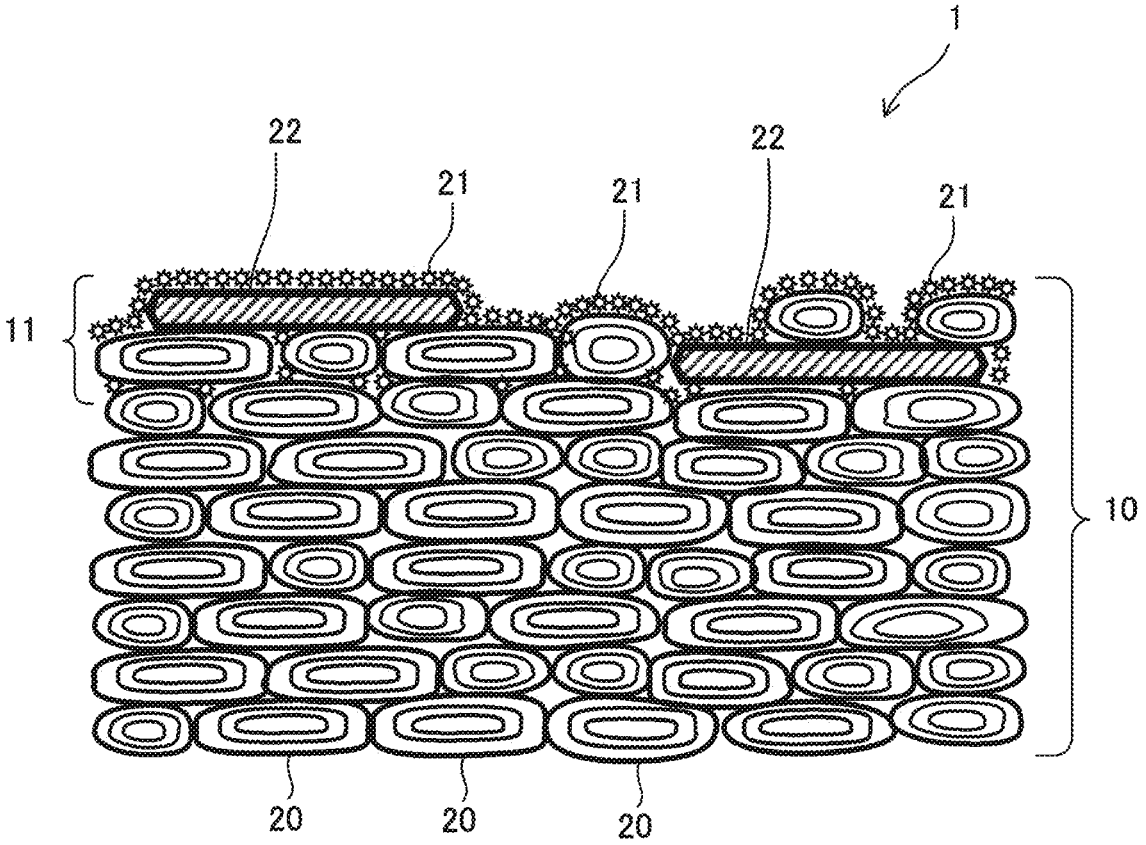
FIG. 2 is a schematic diagram of a cross section of the diaphragm.
Figure 3:
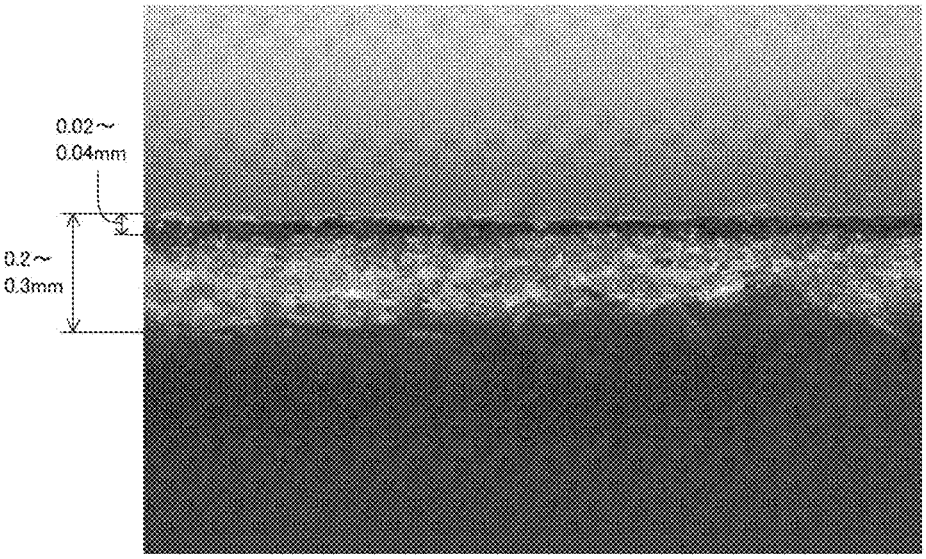
FIG. 3 is an optical micrograph with a magnification of 200 times of the cross-section of the diaphragm.
Figure 4A:
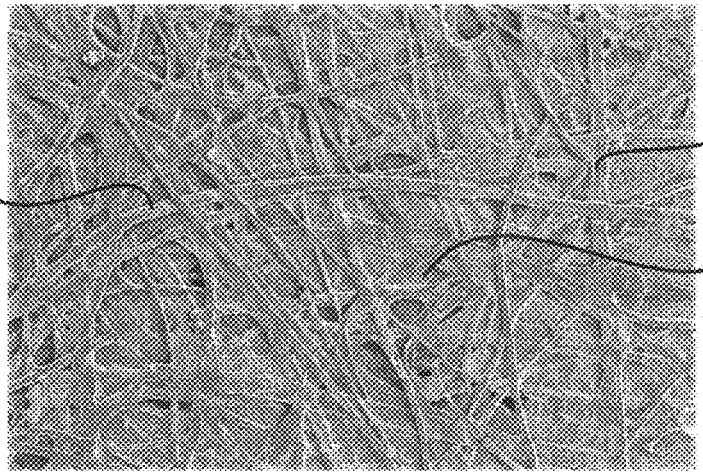
FIG. 4A is a scanning electron micrograph with a magnification of 100 times of the diaphragm including a mixed layer in which pulps, mica and ultra-short cellulose nanofibers at a surface of a base material are mixed.
Figure 4B:
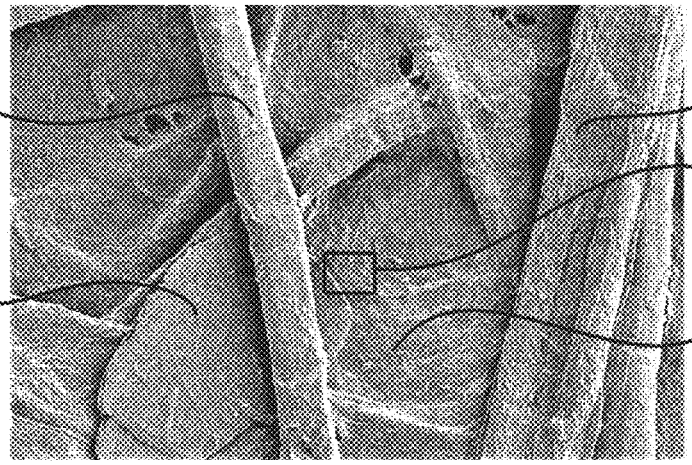
FIG. 4B is a scanning electron micrograph with a magnification of 1,000 times of the diaphragm in FIG. 4A.
Figure 4C:
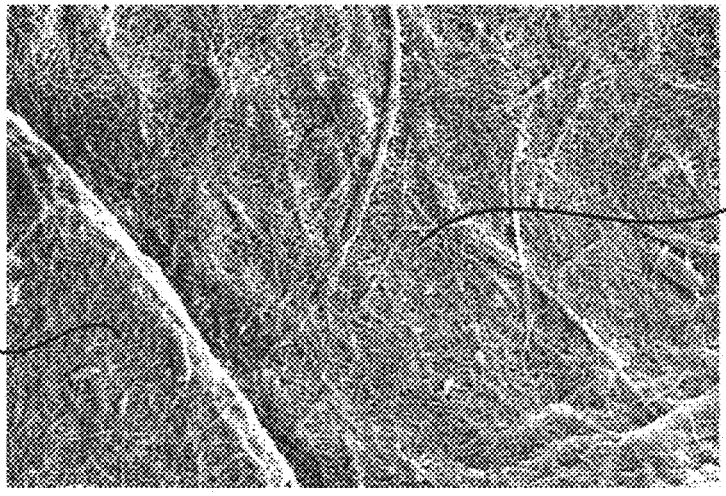
FIG. 4C is a scanning electron micrograph with a magnification of 10,000 times of the diaphragm in FIG. 4A.
Figure 5A:
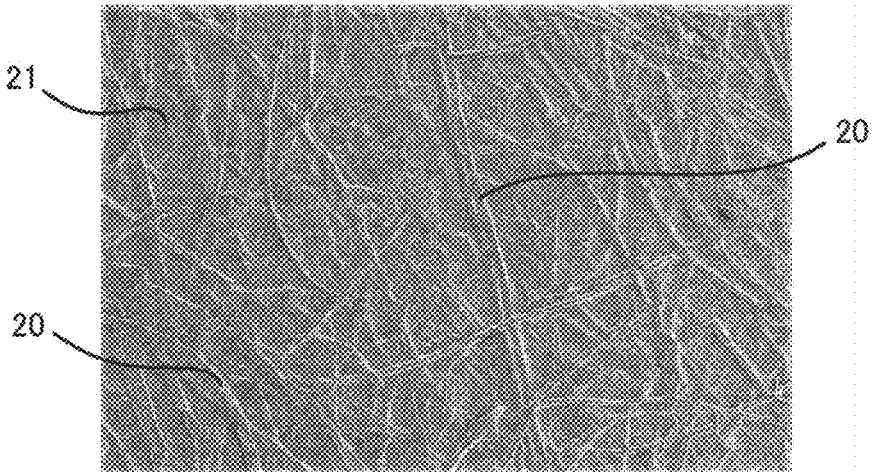
FIG. 5A is a scanning electron micrograph with a magnification of 100 times of a diaphragm including a mixed layer in which pulps, mica, and ultra-long cellulose nanofibers at a surface of a base material are mixed.
Figure 5B:
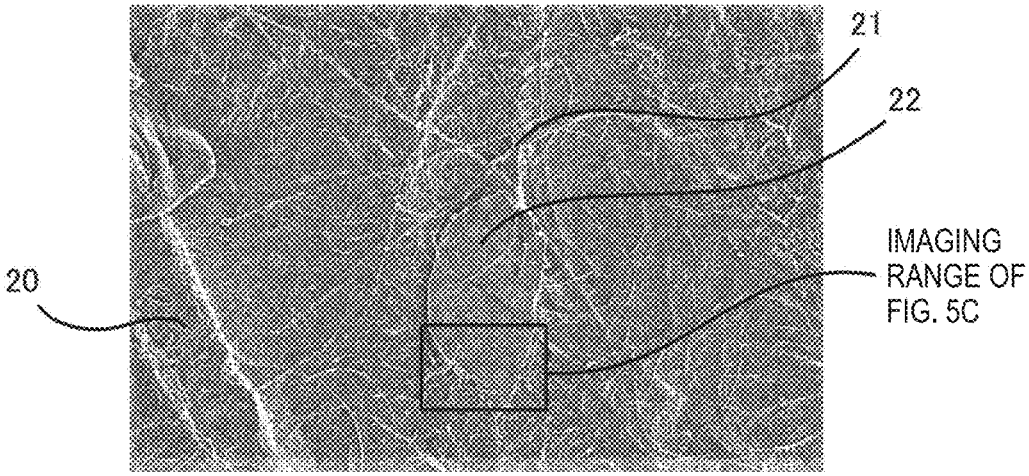
FIG. 5B is a scanning electron micrograph with a magnification of 1,000 times of the diaphragm in FIG. 5A.
Figure 5C:
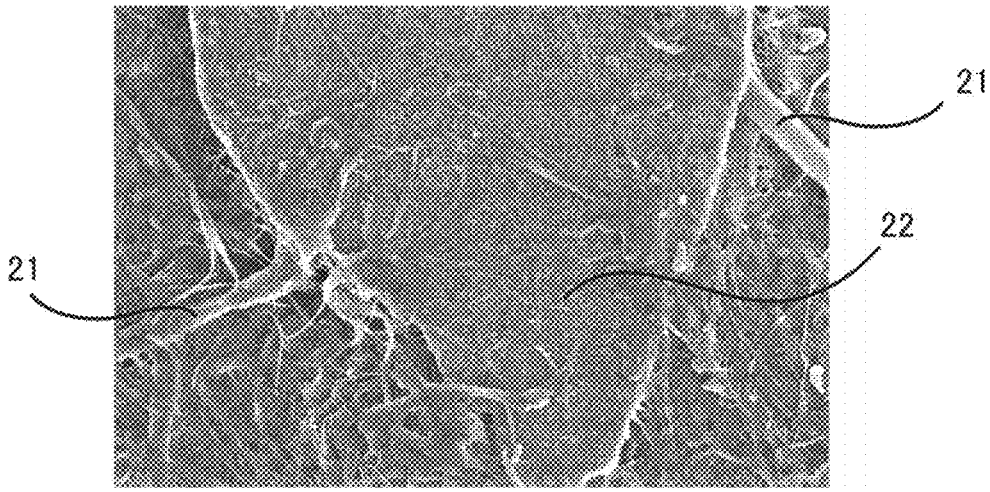
FIG. 5C is a scanning electron micrograph with a magnification of 5,000 times of the diaphragm in FIG. 5A.

FIG. 1A is a perspective view illustrating a diaphragm for an electroacoustic transducer according to an embodiment of the present invention; FIG. 1B is a cross-sectional view thereof; FIG. 2 is a schematic diagram of a cross section of the diaphragm; FIG. 3 is an optical micrograph of the cross-section of the diaphragm; FIG. 4A is a scanning electron micrograph with a magnification of 100 times of the diaphragm including a mixed layer in which pulps, mica and ultra-short cellulose nanofibers at a surface of a base material are mixed; FIG. 4B is a scanning electron micrograph with a magnification of 1,000 times of the diaphragm in FIG. 4A; FIG. 4C is a scanning electron micrograph with a magnification of 10,000 times of the diaphragm in FIG. 4A; FIG. 5A is a scanning electron micrograph with a magnification of 100 times of a diaphragm including a mixed layer in which pulps, mica and ultra-long cellulose nanofibers at a surface of a base material are mixed; FIG. 5B is a scanning electron micrograph with a magnification of 1,000 times of the diaphragm in FIG. 5A; and FIG. 5C is a scanning electron micrograph with a magnification of 5,000 times of the diaphragm in FIG. 5A.

A diaphragm 1 (a diaphragm for an electroacoustic transducer) illustrated in FIG. 1A and FIG. 1B is a diaphragm for a speaker and has a cone shape (truncated cone shape). An opening side of the diaphragm 1 having a small diameter is attached to a vibration source of the speaker such as a voice coil (not illustrated). An inner surface of a conical portion of the diaphragm 1 becomes a sound radiation surface (front surface) which is a surface visually recognizable from outside. On the other hand, various devices of the speaker (not illustrated) are disposed on an outer surface (back surface) side of the conical portion of the diaphragm 1.

In the diaphragm 1, at a front surface side surface layer of a base material 10 made of a fiber material which is mainly composed of cellulose, a mixed layer 11 in which the fiber material, mica and cellulose nanofibers (CNF) are mixed is formed.

Specifically, the base material 10 is made by prepare a liquid of pulps 20 (fiber materials) beaten at a beating degree of 10° SR or more and 50° SR or less and making the liquid to be a paper having a diaphragm shape. The pulp 20 of the present embodiment is a mixture of pulp using coniferous trees as a raw material and pulp using kenaf as a raw material. In addition, pulp such as wood pulp or non-wood pulp can be used as the pulp 20, and a mixture of other wood pulp and the non-wood pulp, single wood pulp, or single non-wood pulp may be used. An average fiber diameter (maximum width) of the pulp 20 is preferably 5 μm or more and 90 μm or less. A fiber length of the pulp 20 is not particularly limited, and those having a fiber length used for general papermaking can be appropriately selected.

In the mixed layer 11 formed at the surface layer of the base material 10, as illustrated in detail in FIG. 2, since the pulp 20 and a cellulose nanofiber 21 both have celluloses, a hydrogen bond is formed between the celluloses so that a surface (front surface) of the base material 10 is covered with the cellulose nanofibers 21. A part of the cellulose nanofibers 21 also enters a gap between the pulps 20, and reach from the first to third pieces of the pulps 20 in a depth direction from the outermost surface of the base material 10 in an example illustrated in the schematic view of FIG. 2.

Mica 22 is covered with the cellulose nanofibers 21 by the hydrogen bond between the cellulose nanofibers 21, and is fixed to the surface layer of the base material 10 by a hydrogen bond between the cellulose nanofiber 21 covering the surface of the mica 22 and the pulp 20 of the base material 10. Further, for example, as illustrated in FIG. 2, a part of the mica 22 enters a gap between the pulps 20 and is covered with the cellulose nanofiber 21. Since the thickness of the cellulose nanofiber 21 covering the mica 22 is sufficiently thin, it is possible to easily identify the mica 22 through the cellulose nanofiber 21 from the appearance.

FIG. 2 is an image diagram of a surface layer of the diaphragm 1. In FIG. 2, each element is exaggerated from an actual size in order to clarify a relationship between the pulp 20, the cellulose nanofiber 21, and the mica 22, but actually, as illustrated in FIG. 3, a thickness of the base material 10 is 0.2 mm or more and 0.3 mm or less on average, and a thickness of the mixed layer 11 is 0.02 mm or more and 0.04 mm on average, which is about 10% of the thickness of the base material 10. In FIG. 3, in order to make it easy to identify the mixed layer 11 of the base material 10, the pulp 20 of the base material 10 is not stained but only the cellulose nanofiber 21 is stained with black.

As illustrated in FIGS. 4A to 4C and 5A to 5C, the cellulose nanofibers 21 are deposited over an entire surface of the base material 10, and the mica 22 is scattered therein. As illustrated in FIGS. 4B, 4C. 5B, and 5C, the cellulose nanofibers 21 are deposited on the surface of the mica 22, and the surface of the mica 22 is covered with the cellulose nanofibers 21. Further, a gap between the pulps 20 on the surface of the base material 10 is covered with the mica 22 and the cellulose nanofiber 21.

The mixed layer 11 may be formed by spraying a suspension containing the mica 22 and the cellulose nanofiber 21 onto the surface (the other surface) of the base material 10 by, for example, a spray coating method while suctioning and dehydrating the base material 10 which is subjected to papermaking from a back surface (one surface) side thereof, so as to permeate (infiltrate) the mica 22 and the cellulose nanofiber 21 into the surface layer of the base material 10, and thereafter, the diaphragm 1 including the mixed layer 11 is produced through molding and drying steps by hot pressing and the like. By spraying the suspension of the mica 22 and the cellulose 21 onto the front surface of the base material 10 and applying the suspension to the base material 10 in a state where the base material 10 is suctioned and dehydrated from the back surface side thereof, the mica 22 and the cellulose nanofiber 21 are smoothly landed on the surface layer of the base material 10 without disturbing the disposition of the pulps 20 of the base material 10 due to the moisture of the suspension, and the mixed layer 11 in which the pulps 20, the mica 22, and the cellulose nanofibers 21 are mixed can be thinly and uniformly formed. Accordingly, a content of the mica 22 in the diaphragm 1 can be reduced without forming a layer with a large amount of mica 22, and an increase in the mass of the diaphragm 1 can be suppressed. Further, since the mica 22 and a part of the cellulose nanofiber 21 can enter the gap between the pulps 20, adhesion between the base material 10 and the mica 22 can be enhanced, and the mica 22 can be firmly fixed to the base material 10.

The cellulose nanofiber 21 is a fiber having a fiber diameter of nanolevel, and has a smaller fiber diameter than the pulp 20. The cellulose nanofiber 21 is derived from, for example, coniferous trees and preferably has an average fiber length of 50 μm or less and an average fiber diameter of 10 nm or more and 50 nm or less. The cellulose nanofiber 21 is not limited to fibers derived from coniferous trees, and other fibers containing cellulose are used. As the fiber length of the cellulose nanofiber 21 becomes shorter, the cellulose nanofiber 21 can be thinly and uniformly deposited at a high density at the surface layer of the base material 10 made of the pulps 20 or on the surface of the mica 22. Accordingly, the adhesion between the base material 10 and the mica 22 can be improved, and the mica 22 can be more reliably fixed to the base material 10. Further, as the fiber length of the cellulose nanofiber 21 becomes shorter, the surface of the base material 10 and the mica 22 can be covered in a thinner way, and an amount of the cellulose nanofiber 21 used can be suppressed to reduce the cost. Further, as the fiber length of the cellulose nanofiber 21 becomes shorter, the mixed layer 11 which is smoother, more uniform and higher in density can be formed.

If the mica 22 is too small, it becomes difficult to identify the mica 22, and if the mica 22 is too large, the texture becomes rough and the design property of the diaphragm 1 may be deteriorated, and thus a particle size of the mica 22 is preferably 10 μm or more and 500 μm or less. The mica 22 may be natural mica or synthetic mica. Further, the mica 22 is preferably coated with titanium oxide, iron oxide, and the like and having gloss in order to improve the design of the diaphragm 1.

A mass-based blending ratio of the mica 22 to the cellulose nanofiber 21 (content of mica/content of cellulose nanofiber) is preferably 2/98 or more and 20/80 or less, and more preferably 5/95 or more and 10/90 or less. By setting a blending ratio of the mica 22 to the cellulose nanofiber 21 to 2/98 or more and 20/80 or less, the mica 22 and the cellulose nanofiber 21 can be thinly deposited on the surface layer of the base material 10 in a state where the surface of mica 22 is uniformly covered with the cellulose nanofiber 21. Therefore, an amount of mica 22 used and the amount of the cellulose nanofiber 21 used can be reduced. Then, the Young's modulus of the diaphragm 1 can be increased by the mixed layer 11 formed to be thin, a sound velocity of the diaphragm 1 can increase, and a decrease in an internal loss (tan δ) of the entire diaphragm 1 can be suppressed. More preferably, by setting a blending ratio of the mica 22 to the cellulose nanofiber 21 to 5/95 or more and 10/90 or less, physical properties and acoustic performance of the diaphragm 1 can be improved, the mica 22 can be uniformly scattered on a front surface of the diaphragm 1, and appearance design of the diaphragm 1 can be improved.

Further, a mass-based blending ratio of the pulp 20 to the mica 22 and the cellulose nanofiber 21 constituting the base material 10 (content of pulp/content of mica and cellulose nanofiber) is preferably 1/99 or more and 8/92 or less, and more preferably 2/98 or more and 5/95 or less. By setting the blending ratio to 1/99 or more and 8/92 or less, the Young's modulus of the diaphragm 1 can be improved, the decrease in the internal loss can be suppressed, and the diaphragm 1 having excellent physical properties and acoustic performance can be formed. Further, by setting the blending ratio to 2/98 or more and 5/95 or less, the diaphragm 1 having an excellent balance between the Young's modulus and the internal loss can be formed.

Further, in the diaphragm 1, since air permeability can be reduced by filling the gap between the pulps 20 at the surface layer of the base material 10 with the mica 22 and the cellulose nanofiber 21, a sound pressure of the diaphragm 1 can be improved, and water resistance of the diaphragm 1 can be further improved. Further, the speaker using the diaphragm 1 can prevent moisture from entering the inside of the speaker through the diaphragm 1. Therefore, the diaphragm 1 can be suitably used for an in-vehicle speaker. In the mixed layer 11, since the gap between the pulps 20 is filled with the mica 22 and the cellulose nanofiber 21 and the density is high, when a waterproofing agent such as an emulsion fluorine water repellent agent is mixed in the suspension of the mica 22 and the cellulose nanofiber 21, the waterproofing agent is easily fixed to the mixed layer 11. Therefore, the moisture on the front surface of the diaphragm 1 can be repelled by the waterproofing agent, and a high waterproof effect can be obtained. Further, the pulp 20 and the waterproofing agent are mixed when the base material 10 is subjected to papermaking, the base material 10 can be waterproofed, and in this case, a higher waterproof effect can be obtained.

In the diaphragm 1 configured as described above, the surface of the mica 22 is covered with the cellulose nanofiber 21 without using a coating material such as a resin or an adhesive, and the mica is fixed to the base material 10 by the hydrogen bond between the cellulose nanofibers 21 and the hydrogen bond between the pulp 20 and the cellulose nanofiber 21 of the base material 10. Since the cellulose nanofiber 21 has a smaller specific gravity than the coating material, it is possible to suppress an increase in mass compared to the case where the mica 22 is fixed by the coating material, and it is possible to form the diaphragm 1 in which the mica 22 having a low affinity with the fiber is reliably fixed to the base material 10. Further, the diaphragm 1 can be produced only by an easy step of spraying the suspension of the mica 22 and the cellulose nanofiber 21 onto the base material 10 without particularly requiring an intermediate layer. Since the mica 22 is fixed to the surface of the base material 10, the physical properties and the acoustic performance of the diaphragm 1 can be improved.

As described above, the diaphragm 1 according to the present embodiment can improve product quality and acoustic characteristics as a diaphragm while suppressing an increase in the cost and complication of a production step.

EXAMPLE

Hereinafter, a physical property comparison result and an air permeability comparison result between an example of the diaphragm for an acoustic transducer according to the present invention and a comparative example of a related-art diaphragm will be described with reference to Tables 1 and 2.

In the comparative example, a diaphragm sample of only a base material made of the pulps is used, and in each of Examples 1 to 4, a diaphragm sample in which a mixed layer in which the pulps of the base material, the mica and the cellulose nanofibers (CNF) are mixed is formed at the surface layer of the base material is used.

Each of the diaphragm samples was prepared such that the dimension thereof was 40 mm in length and 5 mm in width, and a total mass (basis weight) of the sample was constant (±2% or less). Specifically, the diaphragm samples of Examples 1 to 4 were obtained by performing papermaking with a base material fiber using a paper making screen, and then, spraying the suspension of the mica and the cellulose nanofiber onto the front surface of the base material while suctioning and dehydrating the base material from the back surface side thereof, and pressing the base material at a press pressure of 350 kgf by a mold heated to 130° C. to be dried and molded, thereby forming a plain paper making sheet, and cutting the sheet into a sample size.

As the base materials of the comparative example and Examples 1 to 4, 50% of NUKP and 50% of kenaf were mixed as the pulp and beaten at a beating degree of 20° SR.

An ultra-short cellulose nanofiber (BiNFi-s FMa 10010, manufactured by Sugino Machine Limited) was used as the cellulose nanofiber of each of Examples 1 and 2, and an ultra-long cellulose nanofiber (BiNFi-s IMa 10005, manufactured by Sugino Machine Limited) was used as the cellulose nanofiber of each of Examples 3 and 4. Both of the ultra-short cellulose nanofiber and the ultra-long cellulose nanofiber have an average fiber diameter of 10 nm to 50 nm. Further, when these cellulose nanofibers were observed with an optical microscope, the average fiber length of the ultra-short cellulose nanofibers was 1 μm or less, and the average fiber length of the ultralong fiber cellulose nanofibers was 50 μm or less. The mica of each of Examples 1 to 4 has a particle size of 20 μm to 100 μm, and natural mica was used as a base and coated with titanium oxide and iron oxide to impart gloss (MS-100R, manufactured by Nihon Koken Kogyo Co., Ltd.). In each of Examples 1 to 4, the mass-based blending ratio of the mica to the cellulose nanofiber is mica 5:cellulose nanofiber 95.

The mass-based blending ratio of the base material (pulp) to the mica and the cellulose nanofiber is 98:2 in Examples 1 and 3, and 95:5 in Examples 2 and 4.

Table 1 illustrates the physical properties (Young's modulus, sound velocity, specific flexural rigidity, and internal loss) of the diaphragm samples of the comparative example and Examples 1 to 4 measured by a vibration reed method.

TABLE 1

| | Blending Ratio (Mass Ratio) | | Young's | Sound | Specific | |
|---|---|---|---|---|---|---|
| | Base Material | Mica + CNF | Modulus (GPa) | Velocity (m/s) | Flexural Rigidity | tanδ |
| Comparative Example | 100 | 0 | 4.70 | 2558 | 3.565 | 0.0268 |
| Example 1 | 98 | 2 (Mica 5: Extremely Short Fiber CNF 95) | 5.18 | 2646 | 3.582 | 0.0260 |
| Example 2 | 95 | 5 (Mica 5: Extremely Short Fiber CNF 95) | 5.53 | 2741 | 3.725 | 0.0257 |
| Example 3 | 98 | 2 (Mica 5: Extremely Short Fiber CNF 95) | 5.33 | 2702 | 3.705 | 0.0262 |
| Example 4 | 95 | 5 (Mica 5: Extremely Short Fiber CNF 95) | 5.74 | 2785 | 3.767 | 0.0258 |

As is clear from Table 1, the Young's modulus in Examples 1 to 4 increases remarkably as compared with that in the comparative example by fixing the mica to the surface of the base material. On the other hand, an amount of decrease in the internal loss (tan δ) is suppressed. Specifically, with respect to the comparative example, the Young's modulus increases by about 10% and the amount of decrease in the internal loss is suppressed to about 3% in Example 1. Similarly, the internal loss decreases by about 4% while the Young's modulus increases by about 18% in Example 2, the internal loss decreases by about 2% while the Young's modulus increases by about 13% in Example 3, and the internal loss decreases by about 4% while the Young's modulus increases by about 22% in Example 4.

The sound velocity also increases by about 3% in Example 1, about 7% in Example 2, about 6% in Example 3, and about 9% in Example 4 as compared with the comparative example. The specific flexural rigidity also increases by about 0.5% in Example 1, about 4% in Examples 2 and 3, and about 6% in Example 4 as compared with the comparative example.

Next, Table 2 illustrates results of measuring the air permeability of the diaphragm samples of the comparative example and Examples 1 to 4 with a Gurley air permeability tester. The air permeability refers to ventilation time during which 100 cc of air passes through the sample at a constant pressure.

TABLE 2

| | Blending Ratio (Mass Ratio) | | Air |
|---|---|---|---|
| | Base Material | Mica + CNF | Permeability (Sec/100 cc) |
| Comparative Example | 100 | 0 | 16 |
| Example 1 | 98 | 2 (Mica 5: Extremely Short Fiber CNF 95) | 76 |
| Example 2 | 95 | 5 (Mica 5: Extremely Short Fiber CNF 95) | 217 |
| Example 3 | 98 | 2 (Mica 5: Extremely Short Fiber CNF 95) | 3424 |
| Example 4 | 95 | 5 (Mica 5: Extremely Short Fiber CNF 95) | 4636 |

As is clear from values of the air permeability in Table 2, the surface of the base material is covered with the mica and the cellulose nanofiber, and the mica is fixed thereto in Examples 1 to 4, so that the values of the air permeability is larger than that in the comparative example. That is, it means that it takes a long time to pass 100 cc of air and it is difficult for the air to pass through. This effect is more remarkable in the case of using the ultra-long cellulose nanofiber than in the case of using the ultra-short cellulose nanofiber, and the air permeability tends to increase as the blending ratio (mass ratio) of the mica and the cellulose nanofiber to the pulp of the base material is higher. That is, since the gap between the pulp of the base material is filled with the mica and the cellulose nanofiber, it is difficult for the air to pass through, and the water resistance of the diaphragm can be improved.

Although the embodiment and the examples of the present invention have been described above, the aspects of the present invention are not limited to the embodiment and the examples.

In the above embodiment and the examples, the shape of the diaphragm 1 is a cone shape, but the shape of the diaphragm 1 may be other shapes. Further, the mixed layer may be formed not only on the front surface side but also on the back surface side of the base material.

REFERENCE SIGNS LIST

1 diaphragm for electroacoustic transducer
10 base material
11 mixed layer
20 pulp (fiber material)
21 cellulose nanofiber
22 mica

The invention claimed is:

1. A diaphragm for an electroacoustic transducer, comprising a base material having a surface, mica, and a cellulose nanofiber, wherein the base material comprises a fiber material which is mainly composed of cellulose, the mica and the cellulose nanofiber are present as a mixed layer, the mica is present on a part of the surface of the base material, and the cellulose nanofiber is present as a layer of cellulose nanofibers covering (1) a surface of the mica not in contact with the base material and (2) a surface of the base material not covered by the mica, wherein the mica is fixed to the surface of the base material via a hydrogen bond between the base material and cellulose nanofibers covering the surface of the mica not in contact with the base material.

2. The diaphragm for an electroacoustic transducer according to claim 1, wherein a particle size of the mica is 10 μm or more and 500 μm or less.

3. The diaphragm for an electroacoustic transducer according to claim 1, wherein the mica is coated with titanium oxide.

4. The diaphragm for an electroacoustic transducer according to claim 1, wherein a fiber length of the cellulose nanofiber is 50 μm or less.

5. The diaphragm for an electroacoustic transducer according to claim 1, wherein the mixed layer is formed by spraying a suspension comprising the mica and the cellulose nanofiber onto another surface of the base material while suctioning and dehydrating the base material from one surface side thereof.

6. The diaphragm for an electroacoustic transducer according to claim 1, which is for an in-vehicle speaker.

7. The diaphragm for an electroacoustic transducer according to claim 2, wherein the mica is coated with titanium oxide.

8. The diaphragm for an electroacoustic transducer according to claim 2, wherein a fiber length of the cellulose nanofiber is 50 μm or less.

9. The diaphragm for an electroacoustic transducer according to claim 3, wherein a fiber length of the cellulose nanofiber is 50 μm or less.

10. The diaphragm for an electroacoustic transducer according to claim 7, wherein a fiber length of the cellulose nanofiber is 50 μm or less.

11. The diaphragm for an electroacoustic transducer according to claim 2, wherein the mixed layer is formed by spraying a suspension comprising the mica and the cellulose nanofiber onto another surface of the base material while suctioning and dehydrating the base material from one surface side thereof.

12. The diaphragm for an electroacoustic transducer according to claim 3, wherein the mixed layer is formed by spraying a suspension comprising the mica and the cellulose nanofiber onto another surface of the base material while suctioning and dehydrating the base material from one surface side thereof.

13. The diaphragm for an electroacoustic transducer according to claim 4, wherein the mixed layer is formed by spraying a suspension comprising the mica and the cellulose nanofiber onto another surface of the base material while suctioning and dehydrating the base material from one surface side thereof.

14. The diaphragm for an electroacoustic transducer according to claim 7, wherein the mixed layer is formed by spraying a suspension comprising the mica and the cellulose nanofiber onto another surface of the base material while suctioning and dehydrating the base material from one surface side thereof.

15. The diaphragm for an electroacoustic transducer according to claim 8, wherein the mixed layer is formed by spraying a suspension comprising the mica and the cellulose nanofiber onto another surface of the base material while suctioning and dehydrating the base material from one surface side thereof.

16. The diaphragm for an electroacoustic transducer according to claim 9, wherein the mixed layer is formed by spraying a suspension comprising the mica and the cellulose nanofiber onto another surface of the base material while suctioning and dehydrating the base material from one surface side thereof.

17. The diaphragm for an electroacoustic transducer according to claim 10, wherein the mixed layer is formed by spraying a suspension comprising the mica and the cellulose nanofiber onto another surface of the base material while suctioning and dehydrating the base material from one surface side thereof.

18. The diaphragm for an electroacoustic transducer according to claim 2, which is for an in-vehicle speaker.

19. The diaphragm for an electroacoustic transducer according to claim 3, which is for an in-vehicle speaker.

20. The diaphragm for an electroacoustic transducer according to claim 4, which is for an in-vehicle speaker.

* * * * *